US010307929B2

(12) United States Patent
Akaike

(10) Patent No.: US 10,307,929 B2
(45) Date of Patent: Jun. 4, 2019

(54) PUNCHING APPARATUS

(71) Applicant: CANON FINETECH NISCA INC., Misato-shi (JP)

(72) Inventor: Yutaka Akaike, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 3 days.

(21) Appl. No.: 15/428,166

(22) Filed: Feb. 9, 2017

(65) Prior Publication Data

US 2017/0239834 A1 Aug. 24, 2017

(30) Foreign Application Priority Data

Feb. 22, 2016 (JP) ..... 2016-030763

(51) Int. Cl.

| | |
|---|---|
| ***B26F 1/14*** | (2006.01) |
| ***B26D 7/18*** | (2006.01) |
| ***B65H 35/00*** | (2006.01) |
| ***G03G 15/00*** | (2006.01) |
| *B26D 7/00* | (2006.01) |
| *B42C 1/12* | (2006.01) |

(52) U.S. Cl.

CPC ..... *B26F 1/14* (2013.01); *B26D 7/18* (2013.01); *B65H 35/0086* (2013.01); *G03G 15/6582* (2013.01); *B26D 2007/0018* (2013.01); *B42C 1/12* (2013.01); *G03G 2215/00818* (2013.01)

(58) Field of Classification Search

CPC ..... B26F 1/14; B26D 7/18; B26D 2007/0018; B65H 35/0086; G03G 15/6582; G03G 2215/00818; B42C 1/12

USPC ..... 83/684

See application file for complete search history.

(56) References Cited

U.S. PATENT DOCUMENTS

| | | | | |
|---|---|---|---|---|
| 3,636,408 | A * | 1/1972 | Shuman | H05F 3/02 225/6 |
| 4,352,143 | A * | 9/1982 | Uno | H05F 3/02 15/1.51 |
| 4,742,742 | A * | 5/1988 | Yokoe | B26D 7/015 83/101 |
| 7,735,402 | B2 * | 6/2010 | Tsuji | B26D 7/1845 83/166 |
| 7,823,494 | B2 * | 11/2010 | Baba | B26D 5/16 408/135 |

(Continued)

FOREIGN PATENT DOCUMENTS

| | | | |
|---|---|---|---|
| JP | H10-166299 | A | 6/1998 |
| JP | 2003-170393 | A | 6/2003 |

(Continued)

OTHER PUBLICATIONS

Office Action dated May 17, 2018, in Japanese Patent Application No. 2016-030763.

*Primary Examiner* — Ghassem Alie
*Assistant Examiner* — Bharat C Patel
(74) *Attorney, Agent, or Firm* — Venable LLP

(57) ABSTRACT

A punching apparatus, including: a punching portion configured to punch a sheet; and a chad box configured to store a chad of a sheet punched by the punching portion, wherein the chad box includes: a first inner wall portion formed of an insulator; and a second inner wall portion formed of a conductor and arranged above the first inner wall portion.

5 Claims, 7 Drawing Sheets

(56) References Cited

U.S. PATENT DOCUMENTS

| | | | | |
|---|---|---|---|---|
| 8,328,176 | B2 * | 12/2012 | Shimamura | B65H 31/10<br>270/58.08 |
| 8,997,644 | B2 * | 4/2015 | Hotta | B26D 7/32<br>101/26 |
| 9,417,589 | B2 * | 8/2016 | Kubota | G03G 15/6582 |
| 9,606,493 | B2 * | 3/2017 | Irie | G03G 15/6582 |

FOREIGN PATENT DOCUMENTS

| | | | |
|---|---|---|---|
| JP | 2004-098243 | A | 4/2004 |
| JP | 2006-116662 | A | 5/2006 |
| JP | 2008-000851 | A | 1/2008 |
| JP | 2009-241231 | A | 10/2009 |
| JP | 2010-058944 | A | 3/2010 |

* cited by examiner

PUNCHING APPARATUS

BACKGROUND OF THE INVENTION

Field of the Invention

The present invention relates to a punching apparatus configured to punch a sheet.

Description of the Related Art

A sheet processing apparatus including a processing mechanism, which is configured to perform post-processing on a sheet, is mounted to a main apparatus, e.g., a conventional image forming apparatus configured to form an image on the sheet.

As the processing mechanism, there are known a binding mechanism configured to perform binding processing on sheets after gathering and stacking the sheets, a punching mechanism configured to punch file holes in a sheet to store the sheet therein, a folding mechanism configured to perform folding processing on a sheet to store the sheet therein, and a printing mechanism configured to print a predetermined stamp on a sheet to store the sheet therein.

The punching mechanism, which has a punching function of performing punching processing on a sheet, includes a punch member and a die member, which are configured to punch a sheet on which an image is formed in a main body of the image forming apparatus. The punch member and the die member are arranged opposite to each other so as to interpose a sheet on a sheet conveyance path therebetween. A blade at a tip of the punch member is inserted into a hole of the die member, thereby punching the sheet. The above-mentioned punching mechanism includes a chad box configured to store chads formed by performing punching processing on the sheet (Japanese Patent Application Laid-Open No. 2010-58944). The chad box is arranged below the die member, and receives the falling chads.

The sheet is charged with static electricity during conveyance of the sheet and during image formation on the sheet, and the chads stored in the chad box are also charged with electricity. The chads charged with electricity may be attracted onto an inner wall surface of the chad box, or fly about against other chads charged with electricity. Consequently, this poses a problem in that the chads scatter in the chad box. Further, a problem in that the chads fly out of the chad box arises.

SUMMARY OF THE INVENTION

The present invention provides a punching apparatus including a chad box configured to store a chad of a sheet.

According to one embodiment of the present invention, there is provided a punching apparatus, comprising:

a punching portion configured to punch a sheet; and a chad box configured to store a chad of a sheet punched by the punching portion, wherein the chad box comprises:

a first inner wall portion formed of an insulator; and a second inner wall portion formed of a conductor and arranged above the first inner wall portion.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
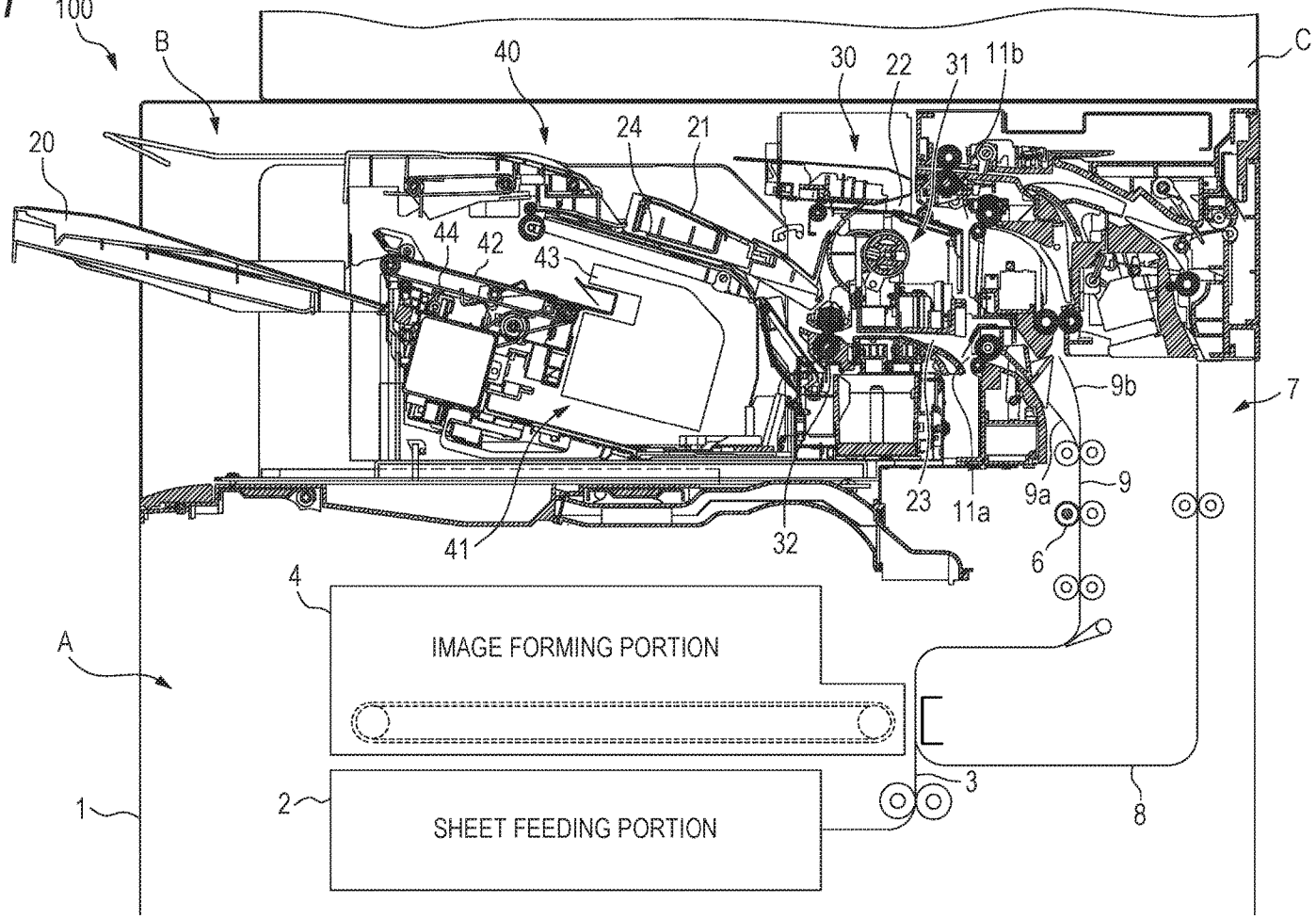
FIG. 1 is a sectional view for illustrating a configuration of an image forming system including a punching apparatus.

FIG. 1 is a sectional view for illustrating a configuration of an image forming system 100 including a punching apparatus 30. The image forming system 100 includes an image forming apparatus A, a post-processing apparatus B including the punching apparatus 30, and an image reading apparatus C. The image reading apparatus C is arranged above the image forming apparatus A.

The post-processing apparatus B includes the punching apparatus 30 configured to punch a sheet, and a binding apparatus 40 configured to bind sheets. In the following description, the punching apparatus 30, which is configured to punch a sheet, is referred to as a punching processing portion 30, and the binding apparatus 40, which is configured to bind sheets, is referred to as a binding processing portion 40. As described above, the post-processing apparatus B includes the punching processing portion 30 configured to punch a sheet, the binding processing portion 40 configured to bind sheets, and a first stack tray 20 onto which punched and/or bound sheets are delivered. The post-processing apparatus B includes a sheet delivery path 22 and a second stack tray 21. A sheet conveyed from the image forming apparatus A through the sheet delivery path 22 is delivered onto the second stack tray 21 without being post-processed.

The image forming apparatus A illustrated in FIG. will be described. The image forming apparatus A includes a main housing 1 as a main body. In the main housing 1, there are arranged a sheet feeding portion 2, an image forming portion 4, and a conveying portion 7. The sheet feeding portion 2 stores sheets on which images are to be formed.

The sheet feeding portion 2, the image forming portion 4, and the conveying portion 7 are arranged in a frame (not shown) of the main housing 1. The sheet feeding portion 2 includes a plurality of sheet feeding cassettes capable of storing sheets different in size, and a sheet feeding path 3 through which a sheet is conveyed from each of the sheet feeding cassettes to the image forming portion 4. The image forming portion 4 forms an electrostatic latent image on photosensitive members (a drum and an endless belt) with a light beam emitted from a light source such as a semiconductor laser or a light emitting diode (LED), and then develops the image with toner (ink). After that, the image is transferred onto a sheet by a charger. Then, the image is fixed on the sheet by a heating device 6 (fixing rollers), and the sheet is conveyed to a first delivery port 11*a* or a second delivery port 11*b* of the main housing 1 through a sheet delivery path 9.

The conveying portion 7 includes the sheet delivery path 9 through which a sheet is conveyed from the image forming portion 4 to the first delivery port 11*a* or the second delivery port 11*b*, a plurality of conveying rollers, and a conveying belt. The first delivery port 11*a* and the second delivery port 11*b* are formed at different positions in the main housing 1. Accordingly, the sheet delivery path 9 includes a first branch path 9*a* and a second branch path 9*b* which branch off therefrom. Through the first branch path 9*a*, the sheet is conveyed to the first delivery port 11*a*. Meanwhile, through the second branch path 9*b*, the sheet is conveyed to the second delivery port 11*b*.

Further, a sheet to be post-processed is conveyed through the first branch path 9*a* to the first delivery port 11*a*. A sheet that is not to be post-processed is conveyed through the second branch path 9*b* to the second delivery port 11*b*. Further, the conveying portion 7 includes a duplex path 8 through which a sheet having an image formed thereon is reversed and then conveyed to the image forming portion 4 again.

The image reading apparatus C includes a platen (not shown) on which an original is to be set, a carriage (not shown) including a light source (not shown) configured to irradiate the original, and a reading element (not shown) configured to receive reflected light from the original through scanning (moving) of the carriage. The reading element photoelectrically converts the reflected light, to thereby read an image on the original. Further, a feeder unit, which is configured to feed originals, is mountable to the platen. Originals set on a feed tray are separated one by one, and are conveyed to a reading portion of the platen. After images are read, the originals are delivered onto a delivery tray.

As illustrated in FIG. 1, the post-processing apparatus B includes the punching processing portion 30, the binding processing portion 40, the first stack tray 20, the second stack tray 21, an upstream sheet path 23 formed in the punching processing portion 30, a downstream sheet path 24 formed in the binding processing portion 40, and the sheet delivery path 22 formed above the upstream sheet path 23.

A punching unit 31, which is configured to punch a sheet, is arranged in the punching processing portion 30. The punching unit 31 punches a sheet guided along the upstream sheet path 23, and then conveys the sheet to the binding processing portion 40.

A binding unit 41 is arranged in the binding processing portion 40. The binding unit 41 includes a processing tray 42 on which sheets are gathered and stacked, and a binding mechanism 43 mounted to the processing tray 42. The processing tray 42 includes a support surface configured to support a trailing edge of a sheet conveyed through the downstream sheet path 24. The binding mechanism 43 is arranged on one end side of the processing tray 42, and is configured to bind the sheets stacked on the processing tray 42. A conveying belt 44 is arranged on the processing tray 42. The conveying belt 44 conveys the bundle of sheets along the support surface of the processing tray 42. Further, the bundle of sheets bound is conveyed by the conveying belt 44, and is delivered onto and stacked on the first stack tray 20. Further, the second stack tray 21, onto which a sheet conveyed from the image forming apparatus A is delivered without being post-processed, is arranged above the binding processing portion 40.

Figure 2:
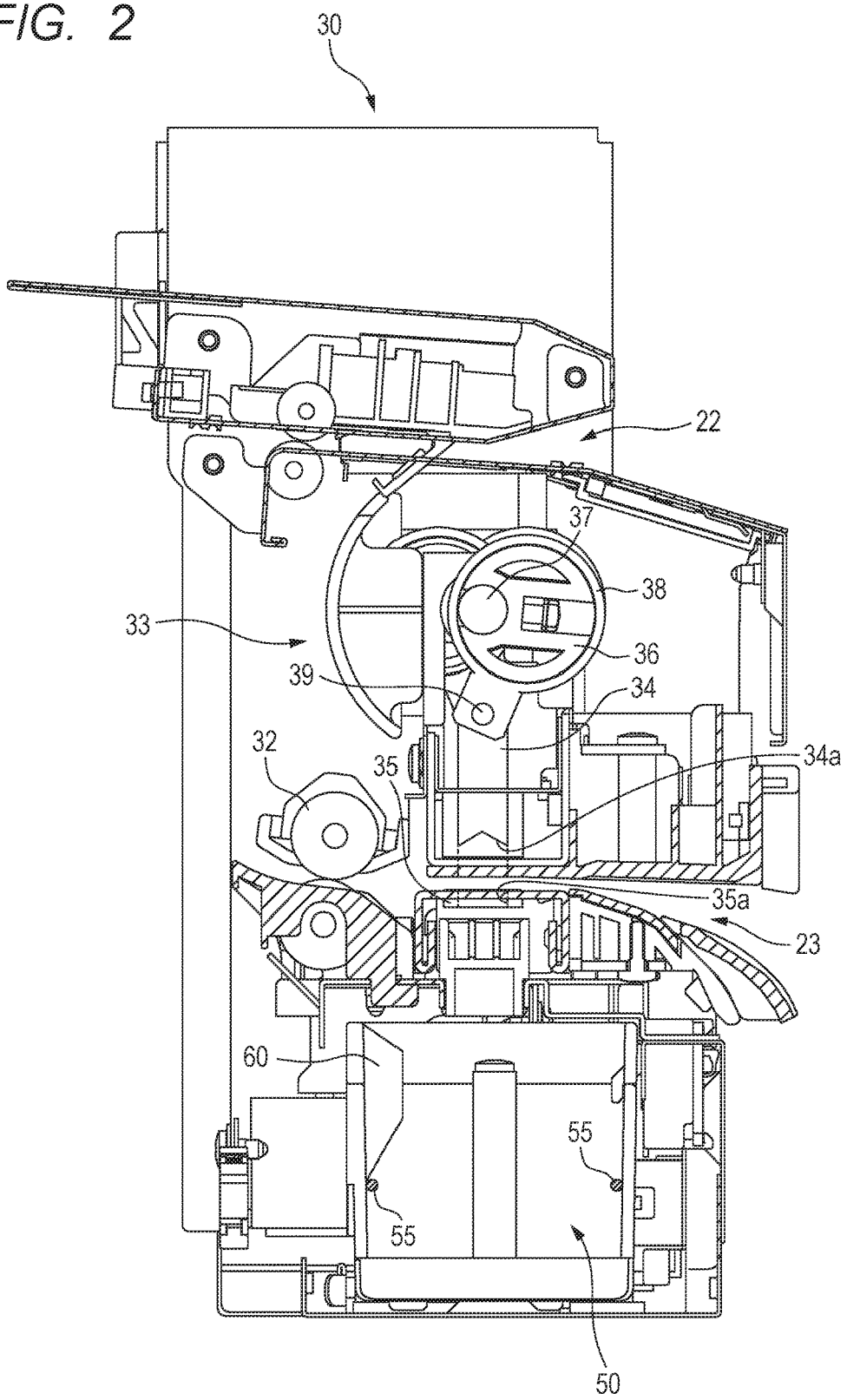
FIG. 2 is an enlarged sectional view for illustrating a configuration of the punching processing portion serving as the punching apparatus.

Now, the punching processing portion 30 will be described in detail. FIG. 2 is an enlarged sectional view for illustrating a configuration of the punching processing portion 30 serving as the punching apparatus. The punching processing portion 30 includes the punching unit 31, the upstream sheet path 23 and the sheet delivery path 22 through which a sheet is guided, a conveying roller pair 32 configured to convey the sheet along the upstream sheet path 23, and a delivery roller pair configured to deliver the sheet guided through the sheet delivery path 22.

The punching unit 31 includes a punching mechanism (a punching portion) 33 configured to punch a sheet passing through the upstream sheet path 23, and a chad box 50 configured to store chads of a sheet punched by the punching mechanism 33.

The punching mechanism 33 includes a punch member 34 including a punch blade 34*a* configured to punch a sheet, and a die member 35 having a receiving hole 35*a* formed therein. The punch member 34 and the die member 35 are arranged opposite to each other across the upstream sheet path 23.

The punch member 34 is mounted in a freely swingable manner to a cam holder 38 through a support shaft 39. The cam holder 38 is mounted in a freely rotatable manner to a rotary cam (eccentric cam) 36. A rotation shaft 37 is driven to rotate through drive of a drive source (not shown), thereby rotating the rotary cam 36. Further, the rotation shaft 37 is rotated by 180 degrees so that the punch member 34 makes a vertical reciprocating motion. In this manner, punching processing is performed.

Figure 6A:
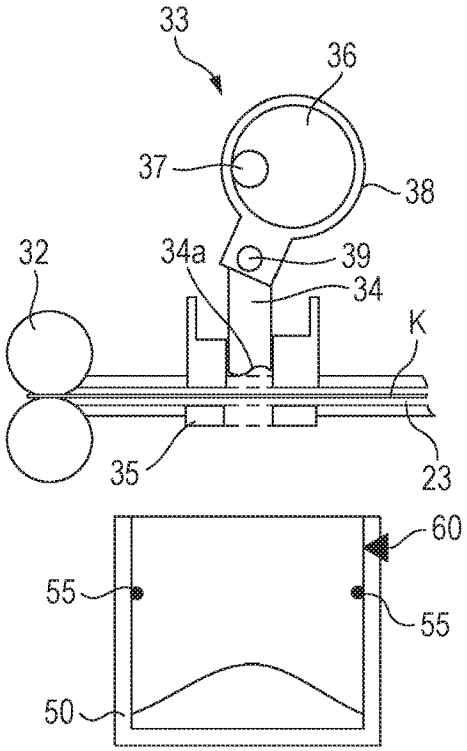
FIG. 6A, FIG. 6B, and FIG. 6C are schematic views for illustrating operation of the punching mechanism of the punching apparatus.
Figure 6B:
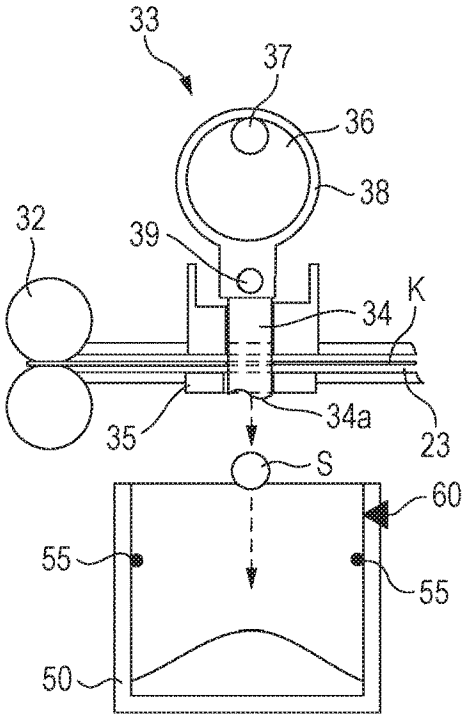
Figure 6C:
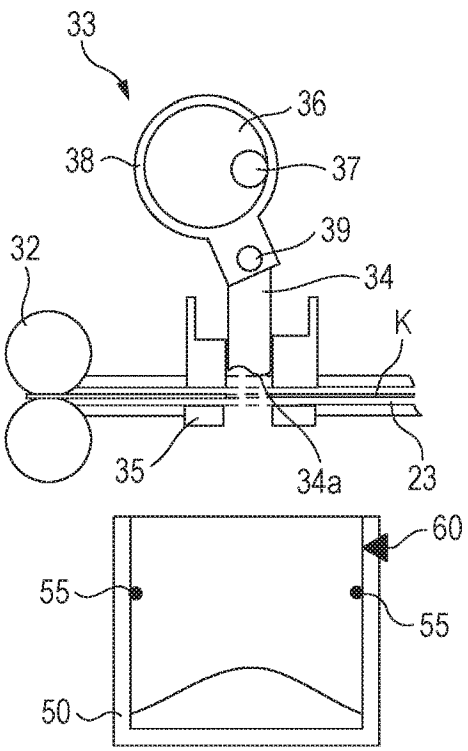

FIG. 6A, FIG. 6B, and FIG. 6C are schematic views for illustrating operation of the punching mechanism 33. As illustrated in FIG. 6A, in a state in which a sheet K is stopped at a predetermined punching position in the upstream sheet path 23, the rotation shaft 37 is driven to rotate, thereby rotating the rotary cam 36 by 90 degrees from an initial position (FIG. 6A). Thus, as illustrated in FIG. 6B, the punch member 34 pierces through the sheet K, and is lowered to a position of the die member 35 below the upstream sheet path 23, thereby punching the sheet. Subsequently, the rotary cam 36 is further rotated by 90 degrees (rotated by 180 degrees from the initial position). In this manner, as illustrated in FIG. 6C, the punch member 34 is retreated to a position above the upstream sheet path 23. Further, the punched sheet is conveyed by the conveying roller pair 32 into the downstream sheet path 24. Chads S of the sheet punched by the punching mechanism 33 fall into the chad box 50 arranged below the die member 35.

Figure 3:
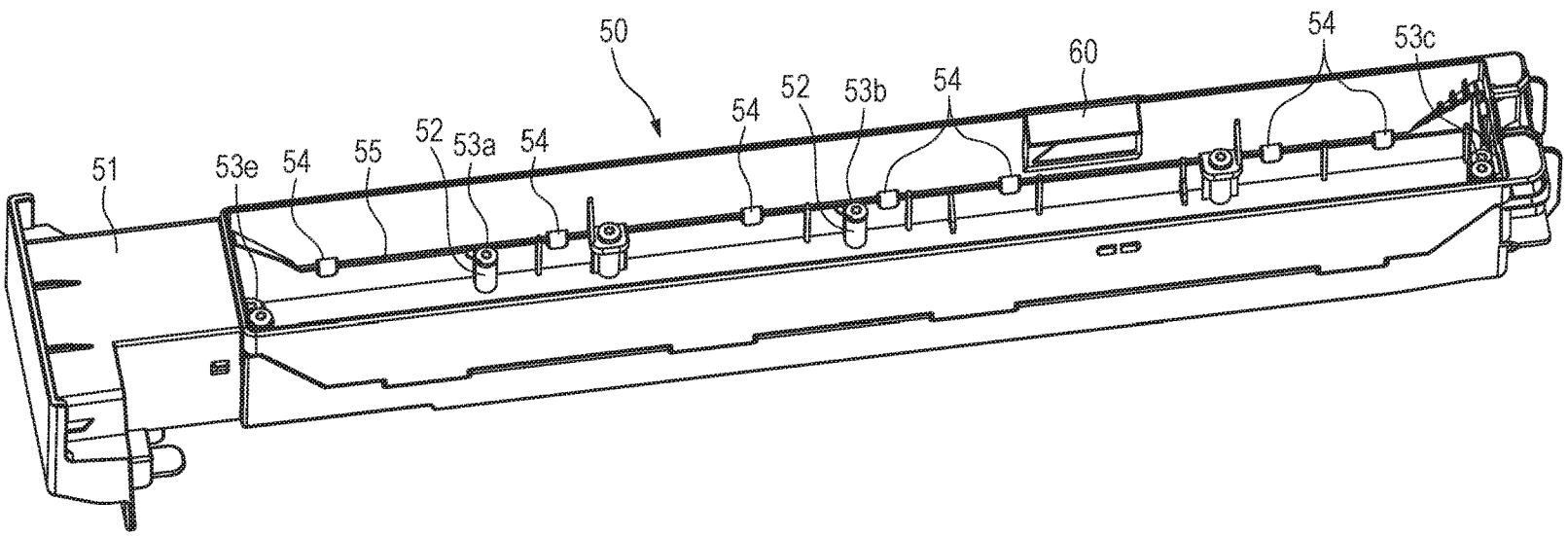
FIG. 3 is a perspective view for illustrating a chad box of the punching apparatus.
Figure 4:
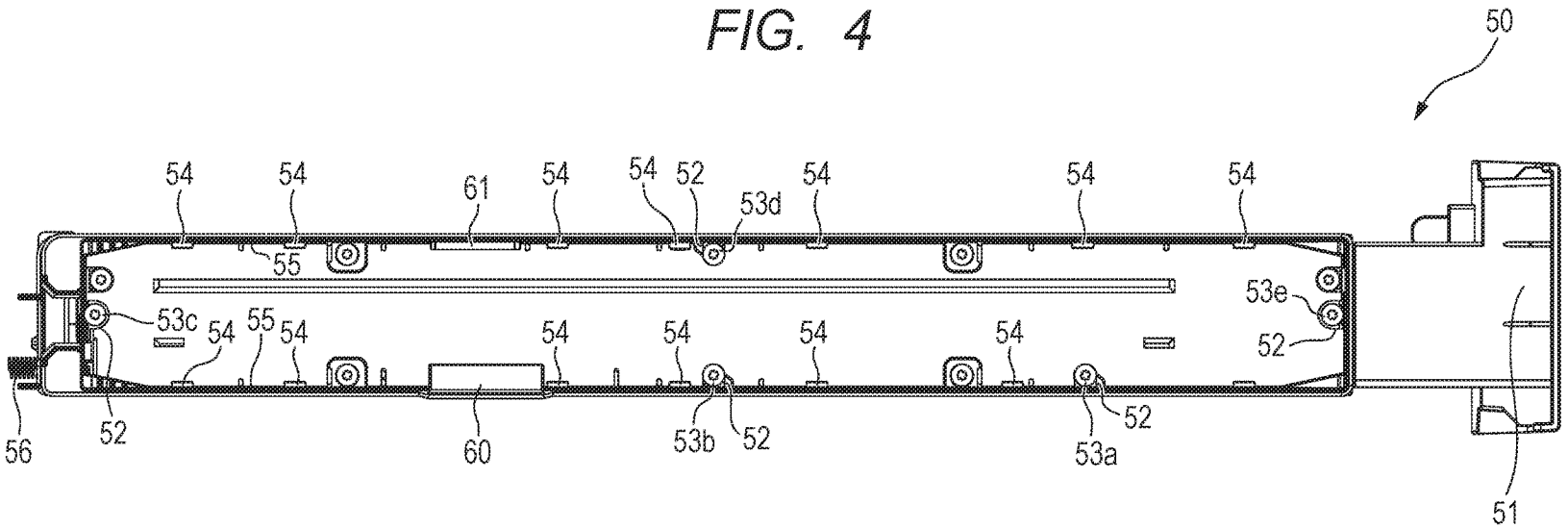
FIG. 4 is a top view for illustrating the chad box of the punching apparatus.
Figure 5:
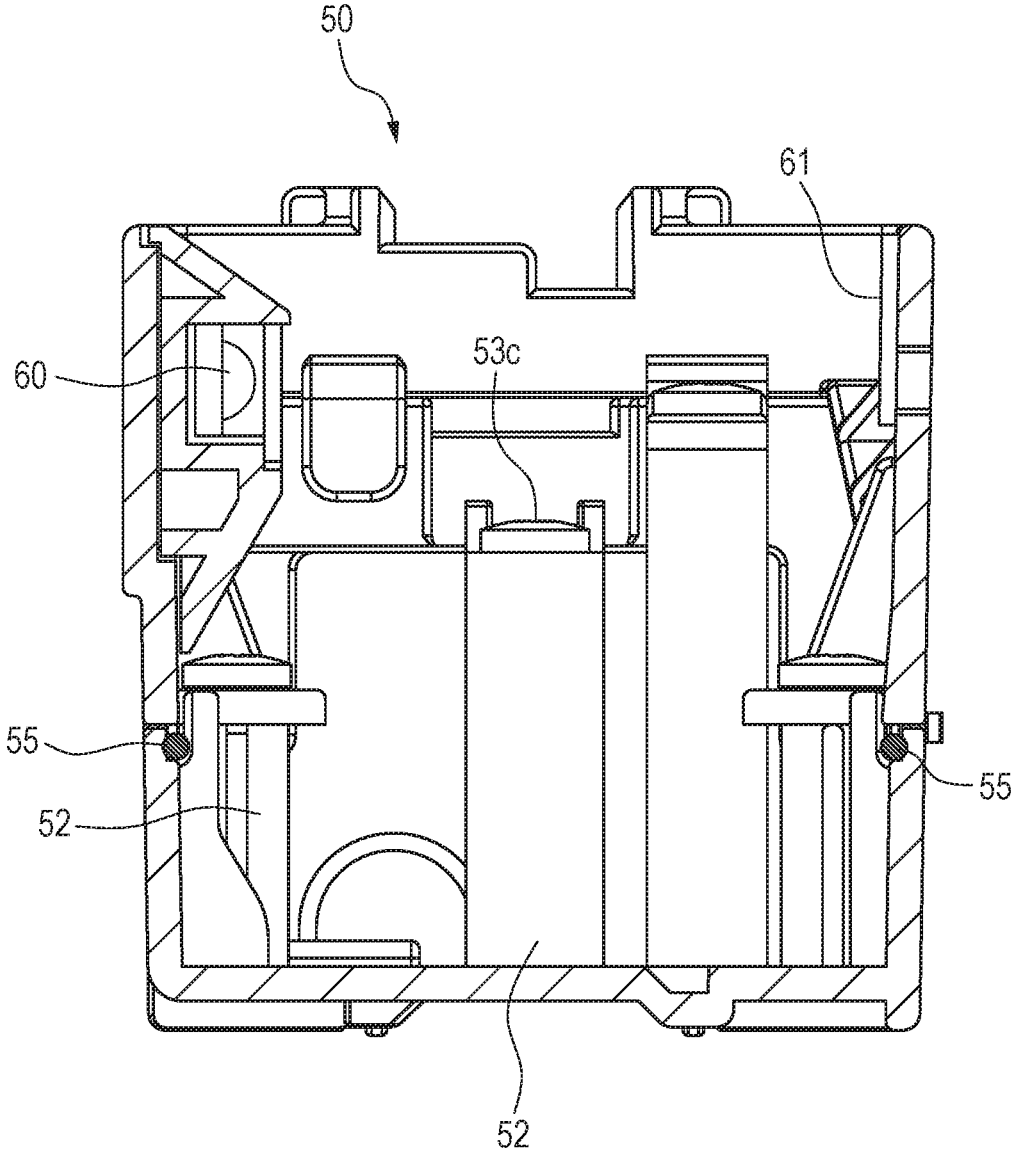
FIG. 5 is a sectional view for illustrating the chad box of the punching apparatus.

FIG. 3 is a perspective view for illustrating the chad box 50. FIG. 4 is a top view for illustrating the chad box 50. FIG. 5 is a sectional view for illustrating the chad box 50. The chad box 50 is arranged below the die member 34 of the punching mechanism 33, and is mounted to the post-processing apparatus B in a freely removable manner. As illustrated in FIG. 3, the chad box 50 is formed into an elongated rectangular parallelepiped shape and made of a resin. The chads S of a sheet punched by the punching mechanism 33 fall into the chad box 50 so as to be stored in the chad box 50. Further, a grip 51 is arranged at one end of the chad box 50 in a longitudinal direction of the chad box 50. The grip 51 is gripped by a user when the user pulls out the chad box 50 from the post-processing apparatus B.

A conductive member is arranged at a predetermined position inside the chad box 50 in a height direction of inner wall surfaces of the chad box 50 in which the chads S are collected. The inner wall surfaces of the chad box 50 are formed of an insulator made of a resin, and a conductor formed of the conductive member. That is, a bottom-surface-side inner wall portion of the inner wall surfaces of the chad box 50 is formed of the insulator, and an inner wall portion above the bottom-surface-side inner wall portion is formed of the conductor. Thus, a portion of the inner wall surfaces from a bottom surface to a predetermined height of the chad box 50 is divided into two layers. In the embodiment, as illustrated in FIG. 3 and FIG. 4, a metal wire 55 is used as the conductive member. Further, in addition to the above-mentioned grounded conductive wire 55, a fullness detector 60 is mounted to the chad box 50. The fullness detector 60 is configured to detect whether or not the chad box 50 is full of the chads S.

The fullness detector 60 is an optical sensor including a light emitting element and a light receiving element. In the vicinity of an opening in an upper portion of the chad box 50, the fullness detector 60 is arranged on one of opposed inner wall surfaces of the chad box 50 extending along a longitudinal direction thereof. Further, a reflecting plate 61 is arranged on another inner wall surface opposed to the one of the inner wall surfaces on which the fullness detector 60 is arranged. That is, the fullness detector 60 is configured such that the reflecting plate 61 reflects light emitted from the light emitting element, and that the light receiving element receives the reflected light.

Next, as illustrated in FIG. 3, FIG. 4, and FIG. 5, the conductive wire 55 is extended on a lower side of the fullness detector 60 over a substantially center portion in the height direction (vertical direction) of the chad box 50 along a horizontal direction of the inner wall surfaces. Specifically, a plurality of mounting portions 52 are formed on the four inner wall surfaces of the chad box 50 along the horizontal direction of the inner wall surfaces. Conductive support screws 53*a* to 53*e* serving as support members, which are configured to support the wire 55, are mounted to the mounting portions 52, respectively. Further, one wire 55 is sequentially wound around bodies of the plurality of support screws 53*a* to 53*e*, thereby extending the wire 55 along the horizontal direction of the inner wall surfaces of the chad box 50. In the embodiment, one end of the wire 55 is wound around the first support screw 53*a*, and the wire 55 is sequentially wound along the inner wall surfaces of the chad box 50 around the second support screw 53*b*, the third support screw 53*c*, and the fourth support screw 53*d* in the stated order. Finally, another one end of the wire 55 is wound around the fifth support screw 53*e*.

A regulating member 54 is formed on each portion between the screws on the inner wall surface of the chad box 50, and is configured to regulate the wire 55 toward the inner wall surface. In the embodiment, the regulating member 54 comprises a hook of an unciform shape and regulates the wire 55 by the wire 55 being interposed between the regulating member 54 and the inner wall surface of the chad box 50.

Further, a ground spring 56 serving as a ground member is mounted on an outer side surface of the chad box 50 on another end side different from the side on which the grip 51 is mounted. The ground spring 56 includes an elastic portion coiled into a spiral shape, and a linear portion extended into a linear shape. An end of the linear portion of the ground spring 56 is wound around the body of the third support screw 53*c*. With this configuration, at the body of the third support screw 53*c*, conduction is established between the wire 55 and the ground spring 56. Meanwhile, when the chad box 50 is mounted to the post-processing apparatus B, an end of the elastic portion of the ground spring 56 is brought into contact with a metal frame (not shown) of the post-processing apparatus B, to thereby be grounded through the metal frame. That is, the wire 55 is grounded through the ground spring 56 and the metal frame of the post-processing apparatus B so as to remove static electricity charging the chads S in the chad box 50.

Figure 7A:
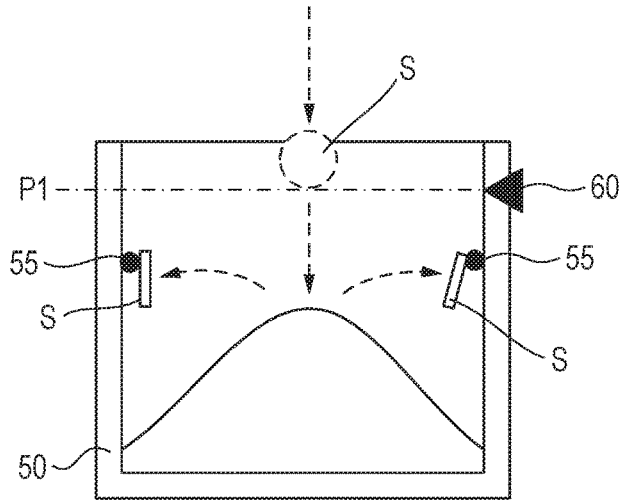
FIG. 7A, FIG. 7B, and FIG. 7C are schematic views for illustrating a state in which chads are stored in the chad box.
Figure 7B:
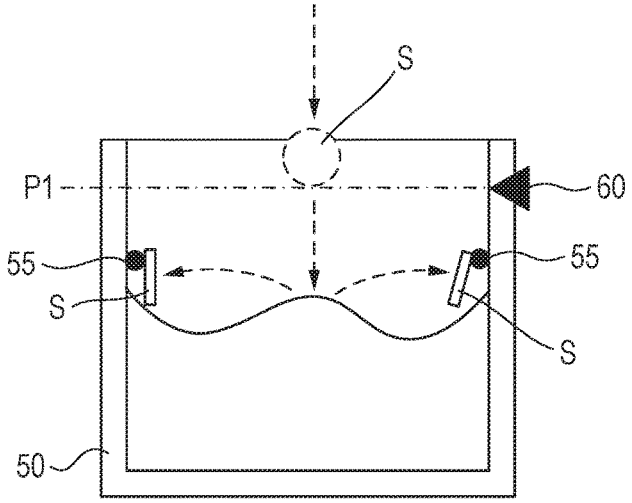
Figure 7C:
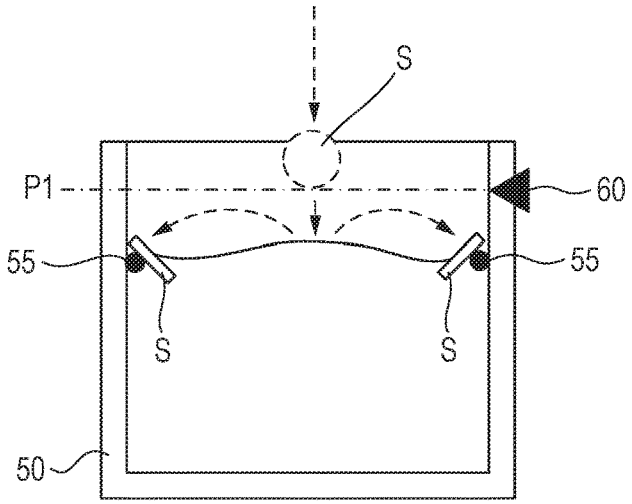

FIG. 7A, FIG. 7B, and FIG. 7C are schematic views for illustrating a state in which the chads S are stored in the chad box 50. The chads S of a sheet punched by the punching mechanism 33 fall into the chad box 50 by their own weights, and are stored in a heap shape in the chad box (see FIG. 7A). At this time, a part of the chads S charged with electricity are attracted onto the inner wall surfaces of the chad box 50. The wire 55 formed of the conductor has a larger attracting force because an electric potential of the chads S with respect to the wire 55 formed of the grounded conductor is higher than an electric potential of the chads S with respect to the insulator made of a resin. Accordingly, the chads S attracted onto the inner wall surfaces of the chad box 50 are attracted toward the wire 55 (see FIG. 7B). Thus, as a height of the chads S stored in the chad box 50 becomes closer to a height of the wire 55, a height of a heap of the chads S is gradually leveled (see FIG. 7C). The height of the heap of the chads S is leveled in the above-mentioned manner, and hence the chads S do not reach a fullness detection position P1 in a state in which there is still a large space in the chad box 50, and the fullness detector 60 can detect fullness when a proper amount of the chads S is stored.

In addition, the wire 55 is extended over a position below the fullness detector 60. Accordingly, at least the chads S having fallen down to a position below the wire 55 are attracted to the wire 55, thereby reducing a sticking of the chads S on the fullness detector 60. Thus, frequency of false detection of the fullness detector caused by the sticking of the chads S can also be reduced.

That is, in the above-mentioned embodiment, the bottom-surface-side inner wall portion of the chad box 50 is formed of the insulator (resin), and an inner wall portion on the opening side with respect to the inner wall portion formed of the insulator is formed of the conductor (wire). The inner wall surfaces of the chad box 50 are formed into the above-mentioned two-layer structure including the insulator and the conductor, thereby being capable of substantially leveling the height of the heap of the chads S. Further, the two-layer structure including the insulator and the conductor is formed on the bottom side with respect to the fullness detector 60, thereby being capable of preventing the chads S from sticking on the fullness detector 60.

In the above-mentioned embodiment, the wire 55 is extended over four inner wall side surfaces of the chad box 50, but the wire 55 may be mounted only on opposed longitudinal surfaces (surfaces extending in the longitudinal direction of the chad box 50) among the inner wall side surfaces of the chad box 50 along the horizontal direction of the inner wall side surfaces. In this case, wires 55 respectively mounted on the opposed longitudinal surfaces among the inner wall surfaces of the chad box 50 may be separately connected and electrically conducted to the ground spring 56 mounted on the outer side surface of the chad box 50, and may be grounded in this manner.

Further, in the above-mentioned embodiment, the conductive wire 55 is used as an extended member. However, as long as a grounded conductive member is used, a member other than the wire 55 may be used. For example, even when, as the extended member, a band-like metal plate is mounted on the lower side of the fullness detector 60 along the horizontal direction of the inner wall surfaces, the same effects as those of the above-mentioned embodiment can be obtained.

Still further, in the above-mentioned embodiment, the ground spring 56 is used to ground the conductive wire 55 through the frame of the post-processing apparatus B. However, the wire 55 may be connected to a self-discharge mechanism so as to discharge an electric charge.

According to the above-mentioned embodiment, scatter of the chads S in the chad box 50 can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-030763, filed Feb. 22, 2016, which is hereby incorporated by reference herein in its entirety.

What is claimed is:

1. A punching apparatus, comprising:

a punching portion which is configured to punch a sheet;

a chad box which includes a bottom surface, a first inner wall surface, a second inner wall surface located adjacent to the first inner wall surface, a third inner wall surface located adjacent to the second inner wall surface, and a fourth inner wall surface located adjacent to the third inner wall surface and the first inner wall surface, a space surrounded by the bottom surface, the first inner wall surface, the second inner wall surface, the third inner wall surface, and the fourth inner wall surface being configured to store a chad of a sheet punched by the punching portion, the chad box being formed of resin;

a conductive wire which extends in a horizontal direction along the first inner wall surface, the second inner wall surface, the third inner wall surface, and the fourth inner wall surface at a predetermined height from the bottom surface;

a first support portion which is configured to support the conductive wire along the first inner wall surface and is provided in the space;

a second support portion which is configured to support the conductive wire along the second inner wall surface and is provided in the space;

a third support portion which is configured to support the conductive wire along the third inner wall surface and is provided in the space; and a fourth support portion which is configured to support the conductive wire along the fourth inner wall surface and is provided in the space.

2. A punching apparatus according to claim 1, further comprising a detector configured to detect chads in the chad box, wherein the detector is arranged above the conductive wire.

3. A punching apparatus according to claim 2, wherein the detector detects that the chad box is full of chads.

4. A punching apparatus according to claim 1, further comprising a ground member configured to ground the conductive wire.

5. A punching apparatus according to claim 1, wherein the conductive wire is made of metal.

* * * * *